US007807910B1

(12) United States Patent
Berardo

(10) Patent No.: US 7,807,910 B1
(45) Date of Patent: Oct. 5, 2010

(54) MUSICAL DRUM WITH MULTIPLE PLAYING SURFACES AND A SEAT FOR THE PLAYER

(76) Inventor: Nicholas Clement Berardo, 116 Dahlia Dr., Mahopac, NY (US) 10541

( * ) Notice: Subject to any disclaimer, the term of this patent is extended or adjusted under 35 U.S.C. 154(b) by 0 days.

(21) Appl. No.: 12/135,177

(22) Filed: Jun. 7, 2008

Related U.S. Application Data

(60) Provisional application No. 61/047,153, filed on Apr. 23, 2008.

(51) Int. Cl.
*G10D 13/02* (2006.01)

(52) U.S. Cl. ..... 84/411 R

(58) Field of Classification Search ..... 84/411 R, 84/421

See application file for complete search history.

(56) References Cited

U.S. PATENT DOCUMENTS 4,214,504 A * 7/1980 Rex ..... 84/411 R
7,128,368 B2 * 10/2006 Sligh ..... 297/186
7,423,210 B2 * 9/2008 Marwede ..... 84/411 R
7,608,769 B2 * 10/2009 Izen et al. ..... 84/411 R

FOREIGN PATENT DOCUMENTS

JP 2007065022 A * 3/2007

* cited by examiner

*Primary Examiner*—Kimberly R Lockett

(57) ABSTRACT

An embodiment of a musical drum with a single outer shell and divided internally into a plurality of resonant chambers. A plate with a plurality of cutouts is mounted to an open end of the outer shell and a plurality of playing surfaces is mounted to the cutouts. The playing surfaces are joined to resonant chambers in the outer shell. The playing surfaces can be tensioned independently and are interchangeable with playing surfaces of similar shape and size, and are constructed of a variety of materials. The outer shell forms a general hourglass shape with a flat side that can be used as a base. A seat for the player is affixed to the outer shell.

4 Claims, 8 Drawing Sheets

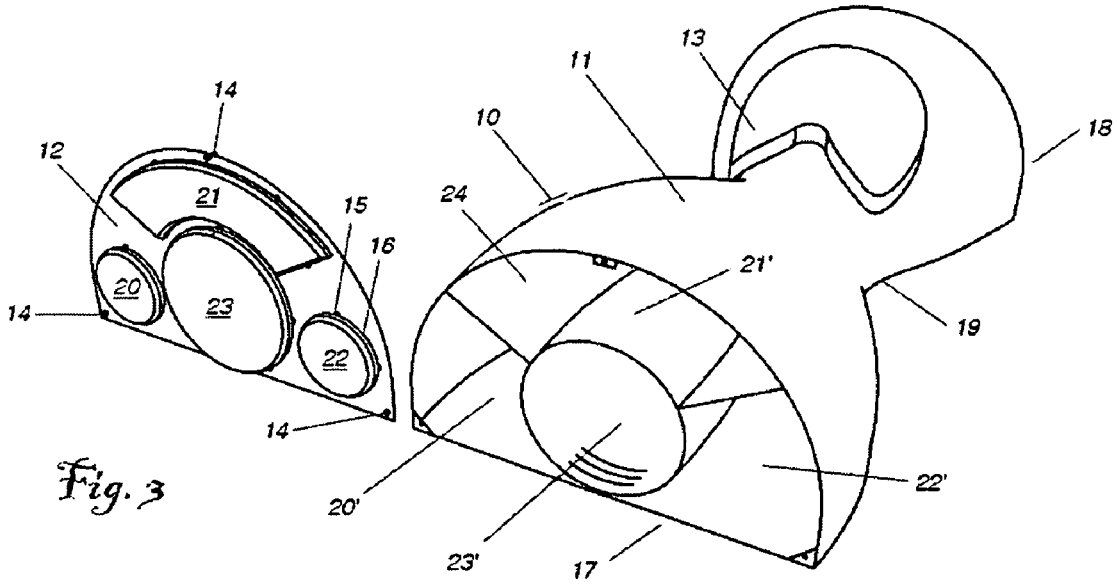
Fig. 3
Fig. 4
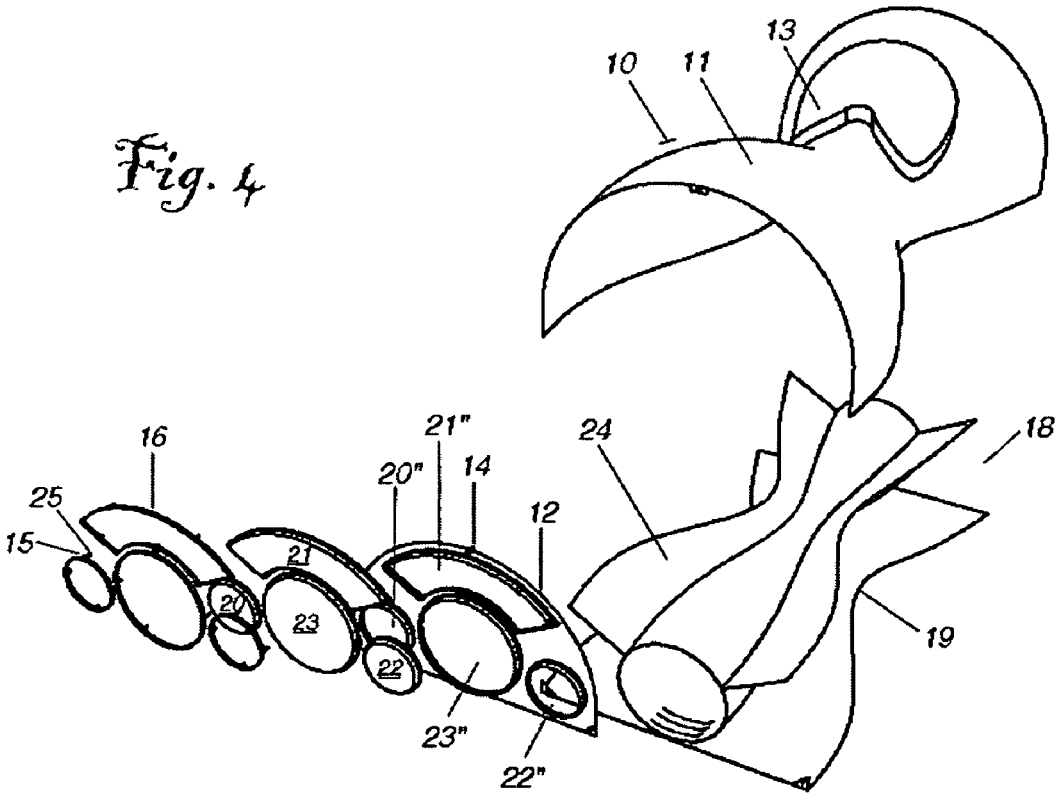

MUSICAL DRUM WITH MULTIPLE PLAYING SURFACES AND A SEAT FOR THE PLAYER

CROSS-REFERENCE TO RELATED APPLICATION

This application claims the benefit of provisional application No. 61/047,153, filed Apr. 23, 2008 by the present inventor.

FEDERALLY SPONSORED RESEARCH

Not Applicable.

SEQUENCE LISTING OR PROGRAM

Not Applicable.

BACKGROUND OF THE INVENTION

The invention relates to musical instruments of the drum or percussion type.

Drums have been around since ancient times and have been used for many different purposes, including communication, religious ceremony and music. As a musical instrument, the basic use of drums has not changed; they are generally used to create rhythm with sound made by striking a playing surface with a hand or with some other implement in various time intervals. The basic structure of drums also has not changed over their long history; they are generally constructed of a single playing surface, traditionally made of an animal skin, attached to a single resonant chamber. A single drum with this basic structure generally produces one tone or a narrow range of tones, depending on how and where a player strikes the single playing surface. Despite the limited number of tonal options that such a drum produces, it still has a great deal of creative potential. A skilled player using a single drum made with this basic structure can create a variety of rhythms.

A number of options have been developed to increase the variety of rhythms available to a player, and hence increase the creative potential of drums. One option is to attach a playing surface to a resonant chamber with a tensioning device that changes the tone of the drum, allowing for a wider range of tones. Another way is to provide a player with two or more drums. This is especially effective if the drums each have different tones. The tone of a drum can be altered by using a tensioning device, by changing the size and material of the playing surface, and by changing the size, shape and material of the resonant chamber. Still another way to increase the variety of rhythms available to a player is to include other types of playing surfaces that are not drums, such as cymbals, bells and chimes. In addition to adding more and different types of playing surfaces, a player can also increase the variety of rhythms available to him or her by arranging the drums in a way that provides convenient access to the playing surfaces. Since playing drums is generally a physical activity that involves coordinated body movement, the spatial relationship of the drums is an important aspect of what and how a player can play. Additionally, since playing drums is a physical activity, a player should be situated in a comfortable position while playing.

DESCRIPTION OF RELATED ART

A review of the prior art for drums will illustrate the types of options that have been developed to increase the variety of rhythms available to a player. It will also illustrate the limitations of these previous approaches.

U.S. Pat. No. 2,858,724 describes a musical drum with a single outer shell and three playing surfaces that is capable of producing three different tones. By attaching all three playing surfaces to a single outer shell, the drum design is compact, which addresses the issue of placing the playing surfaces within convenient reach of the player. This drum design is limited, however, in several ways. First, it only allows for three playing surfaces. Obviously, having more playing surfaces available to a player can allow for more tones, and this can allow for a greater variety of possible rhythms. Second, this design does not allow for much variability in how these playing surfaces are situated in relation to each other. The arrangement of playing surfaces within reach of the player is an important part of determining what and how a player can play. Third, while the author does state the importance of placing the playing surfaces within convenient reach of the player, it does not actually provide the player with a means for positioning himself or herself in relation to the playing surfaces provided by the drum. Finally, the use of a single outer shell for all three playing surfaces, with no distinct resonant chamber for any playing surface, can lead to issues of sound wave interference within the outer shell, leading to poor tonal quality. While this type of interference could be used in creative ways, this drum design does not allow for the possibility of a using single playing surface dedicated to a single resonant chamber. Having a single playing surface dedicated to a single resonant chamber reduces or eliminates issues of interference, and therefore can be an important option to provide in a drum design.

U.S. Pat. No. 4,214,504 describes a compound drum that provides a plurality of distinct resonant chambers contiguously incorporated into a single outer shell. This drum design allows a player to play multiple tones with a single outer shell containing distinct resonant chambers, but it accomplishes this by using a single playing surface stretched over the resonant chambers. One limitation of this design is that it leads to the concern of using vibration dampening points at pinch locations on the playing surface between two or more chambers in order to achieve the distinct drum tones. A further limitation of having a single playing surface stretched over multiple resonant chambers is that this design does not allow for independent tensioning and tuning of playing surfaces over their corresponding resonant chambers. This type of tuning can be an important source of creative variability. These reasons may have contributed to the fact that the compound drum design has not been widely implemented.

U.S. Pat. No. 4,452,121 describes a drum interconnection device. This invention provides a means for several bongo-type drums to be firmly fastened together, allowing the player secure access to multiple drums. This invention does not attempt to incorporate more than one drum into a single outer shell, and so does not provide an instrument that is more compact than the size of several distinct drums grouped together. In addition to possibly being more compact, having a number of playing surfaces incorporated into a single outer shell can also create a more unitary musical instrument, rather than a collection of distinct musical instruments connected together. This invention also does not provide the player with the means for positioning himself or herself in relation to the playing surfaces provided by the drums.

U.S. Pat. No. 6,073,999 describes a drum stand that is connected to a seat. This invention addresses the importance of placing a drum and drummer in convenient spatial relationship to each other in order to allow for comfortable playing over an extended period of time. Placing a drum and drummer in convenient spatial relationship to each other is also a means of increasing the creative potential of the instrument, since what a drummer can play is in part determined by how the instrument is situated in the space around him or her. The drum stand described is intended for use with an individual African type drum, but is not itself an integral part of a musical instrument.

U.S. Pat. App. No. US 2007/0017335 A1 describes a drum with sound reflectors for improved sound quality and a baseplate that allows for an assemblage of drums to be mounted to it. This design is intended for an assemblage of drums and does not attempt to incorporate multiple playing surfaces into a single outer shell. Having multiple playing surfaces attached to a single outer shell has the potential to lead to a more compact design and improved playability. Having a number of playing surfaces incorporated into a single outer shell can also create a more unitary musical instrument, rather than a collection of distinct musical instruments. Also, since this design is intended for an assemblage of distinct drums, it does not allow for the possibility of attaching two or more playing surfaces to a single resonant chamber. Attaching two or more playing surfaces to a single resonant chamber can allow for the creative use of sound wave interference and therefore can be an important option to provide in a drum design. And, finally, this assemblage of drums does not provide a means for the player to position himself or herself in relation to the playing surfaces.

Given the limitations in the prior art, there is still a need for a new drum that addresses the issues described above in a more comprehensive way, and offers further innovations beyond what has been described.

OBJECTS AND SUMMARY OF THE INVENTION

It is an object of the present invention to provide a drum that addresses the issues and limitations described above and that offers further innovations beyond what has been described.

More specifically, it is an object of an embodiment of the present invention to provide a drum with a plurality of distinct playing surfaces that are mounted to cutouts in a plate that is in turn mounted to a single outer shell. The outer shell is divided internally into a plurality of distinct resonant chambers of variable shape and size. The plate is mounted to the outer shell in such a way that each distinct playing surface can be joined to a distinct resonant chamber within the outer shell and more than one distinct playing surface can be joined to a distinct resonant chamber within the outer shell. The cutouts in the plate can have playing surfaces mounted to them in a variety of different arrangements, and in a variety of different shapes and sizes. It is a further object that each distinct playing surface be independently tunable by conventional means of tensioning playing surfaces. Furthermore, each distinct playing surface is intended to be interchangeable with alternate playing surfaces of similar shape and size, with the playing surfaces being constructed of a variety of materials, including, but not limited to, natural and synthetic skins, wood, and metal which can provide sounds such as those made by cymbals, bells and chimes. In addition, the plate also allows playing surfaces to be mounted to it in such close proximity that a player can play two or more playing surfaces simultaneously with a single strike of a hand or other playing implement. It is a still further object to provide a drum with a seat that is an integral part of the instrument design which positions the player in convenient spatial relationship to the multiple playing surfaces.

In accordance with these objects, an embodiment of the musical drum with multiple playing surfaces and a seat for the player provides a drum with a single outer shell made of a rigid natural or synthetic material in a general hourglass shape with an open front end and an open back end. The hourglass shape is cut through lengthwise from front to back in a way that forms a flat base. The flat base of the outer shell can be considered the bottom of the drum. The interior of the outer shell is divided lengthwise into two or more resonant chambers made of a rigid natural or synthetic material. The front opening of each resonant chamber is located toward the front end of the outer shell, and the back opening of each resonant chamber is located toward the back end of the outer shell. The front end of the outer shell is designed to have a rigid frontplate, made of natural or synthetic material, mounted to it. Various shapes are cutout of the frontplate, such as circles and curved rectangles. Each cutout corresponds to a playing surface of similar shape and size. Each playing surface is designed to be mounted to the corresponding cutout in the frontplate using conventional means, allowing each playing surface to be tensioned independently. The frontplate connects to the front end of the outer shell in such a way that one or more playing surface can be positioned on top of the opening of a distinct resonant chamber. The back end of the outer shell can remain open or, alternately, a backplate can be mounted to the back end of the outer shell which would allow a playing surface to be joined to the back opening of each resonant chamber.

Furthermore, the flat base that forms the flat side of the outer shell can be considered the bottom of the drum. The bottom of the drum can be situated on a floor with the front and back ends vertical or nearly vertical to the floor. A cushion or seat can be affixed to the top of the outer shell of the drum where the narrow section of the hourglass shape widens towards the back end. The portion of the outer shell that supports the seat is appropriately reinforced using a rigid material to support the weight of the player. A player utilizing the seat would straddle the drum in such a way that he or she is facing the front end of the drum. A player so situated would have convenient access to the multiple playing surfaces mounted to the frontplate of the drum. Additionally, a player so situated would have convenient access to playing surfaces mounted to the backplate of the drum, if a backplate is included. The drum can also be played by more conventional means, with the player seated in a chair or on a stool and holding the drum between his or her legs.

BRIEF DESCRIPTION OF THE DRAWINGS

FIG. 3 shows a perspective view of an embodiment of the drum as in FIG. 1 looking from front to back with the frontplate removed to expose the resonant chambers within the outer shell FIG. 4 shows a perspective view of an embodiment of the drum as in FIG. 1 looking from front to back with the outer shell partially removed to expose the inner dividers that form the resonant chambers and the frontplate and playing surfaces disassembled

DETAILED DESCRIPTION OF THE INVENTION

Figure 1:
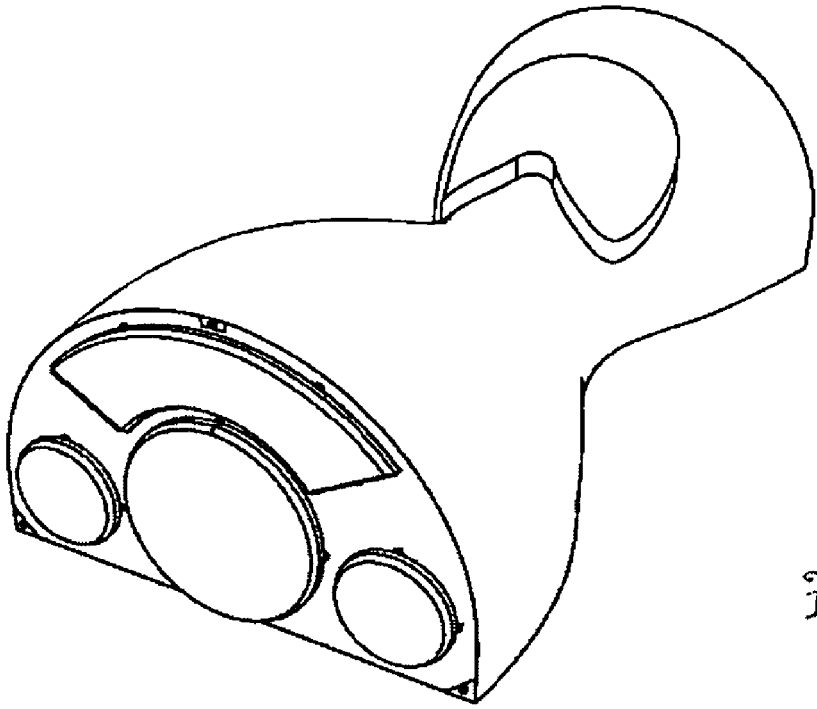
FIG. 1 shows a perspective view of an embodiment of the drum looking from front to back
Figure 2:
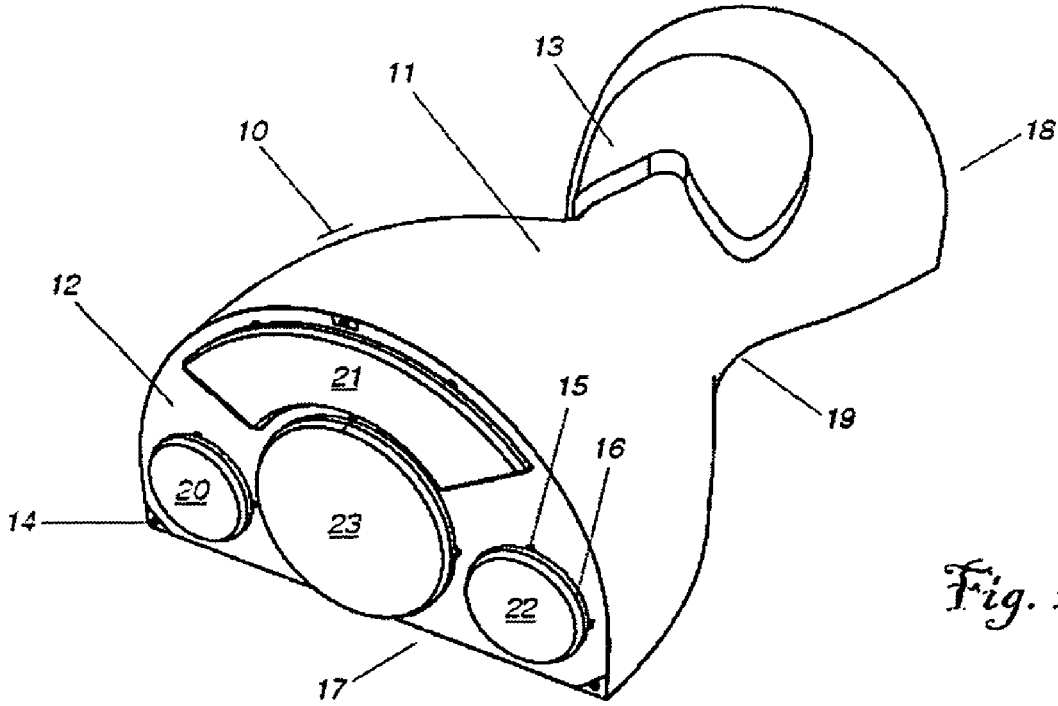
FIG. 2 shows a perspective view of an embodiment of the drum as in FIG. 1 looking from front to back
Figure 5:
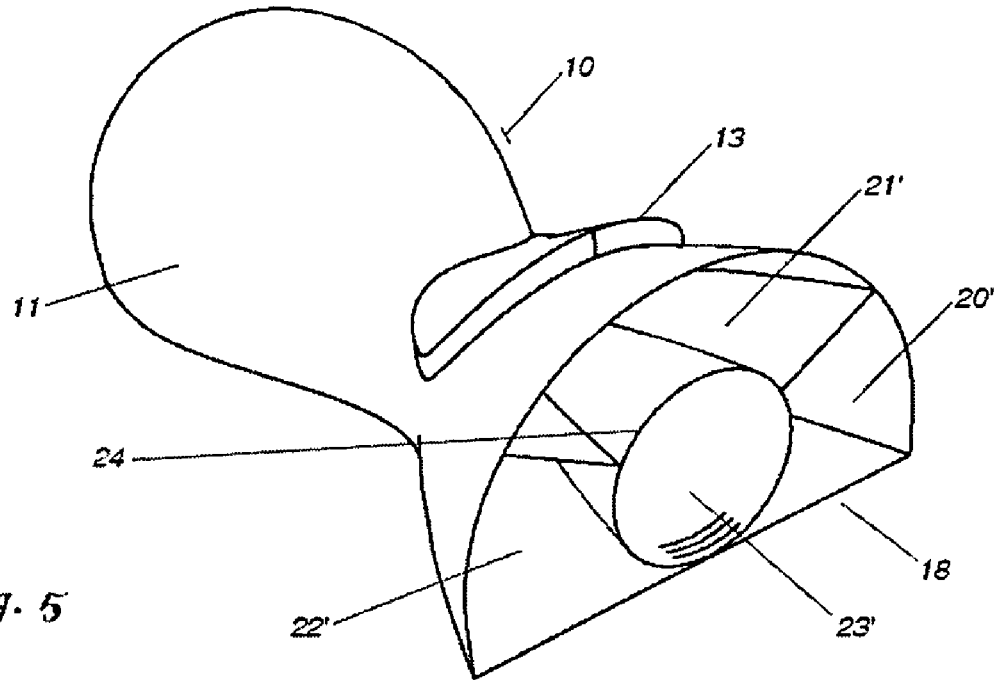
FIG. 5 shows a perspective view of the back of an embodiment of the drum as in FIG. 1

An embodiment of the musical drum with multiple playing surfaces and a seat for the player 10, as seen in FIG. 2, provides a drum with a single outer shell 11 made of a rigid natural or synthetic material in a general hourglass shape with an open front end 17 and an open back end 18. The hourglass shape is cut through lengthwise from front to back in a way that forms a flat base 19. The flat base 19 of the outer shell 11 can be considered the bottom of the drum. The interior of the outer shell 11 is divided lengthwise with dividers 24 to form four distinct resonant chambers 20' 21' 22' 23' as seen in FIGS. 3 and 4. The front opening of each resonant chamber 20' 21' 22' 23' is located toward the front end 17 of the outer shell 11, and the back opening of each resonant chamber 20' 21' 22' 23' is located toward the back end 18 of the outer shell 11, as seen in FIG. 5. The front end 17 of the outer shell 11 is designed to have a rigid frontplate 12 mounted to it using means such as clamps or bolts 14. Various shapes are cutout 20" 21" 22" 23" of the frontplate 12, such as circles and curved rectangles. Each cutout 20" 21" 22" 23" corresponds to a playing surface 20 21 22 23 of similar shape and size. Each playing surface 20 21 22 23 is designed to be mounted to the corresponding cutout 20" 21" 22" 23" in the frontplate 12 using conventional means, such as lugs 15, drum rims 16 and tension rods 25, as seen in FIG. 4, allowing each playing surface to be tensioned independently. The frontplate 12 connects to the front end 17 of the outer shell 11 in such a way that each playing surface 20 21 22 23 is positioned on top of the opening of a corresponding resonant chamber 20' 21' 22' 23'. The frontplate 12 is positioned on top of the openings of the resonant chambers 20' 21' 22' 23' in a way that creates a sound resistant connection between the frontplate and the edges of the resonant chambers, which can include the use of matching grooves on the inside of the frontplate to the resonant chamber edges and the use of material such as rubber.

Figure 6:
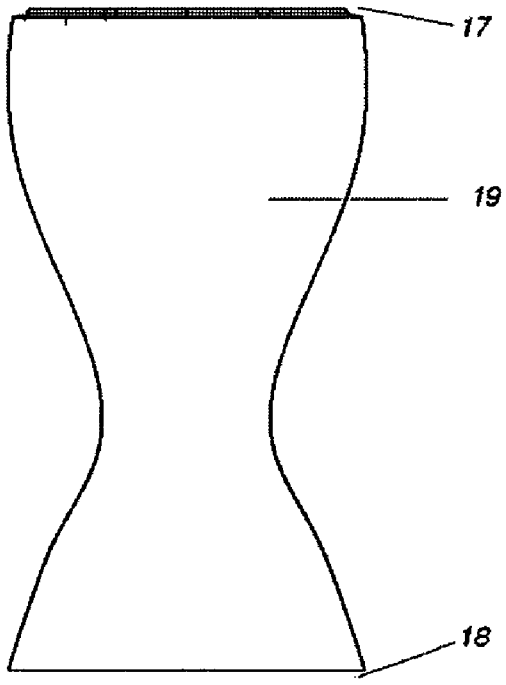
FIG. 6 shows a view of the bottom of an embodiment of the drum as in FIG. 1
Figure 14:
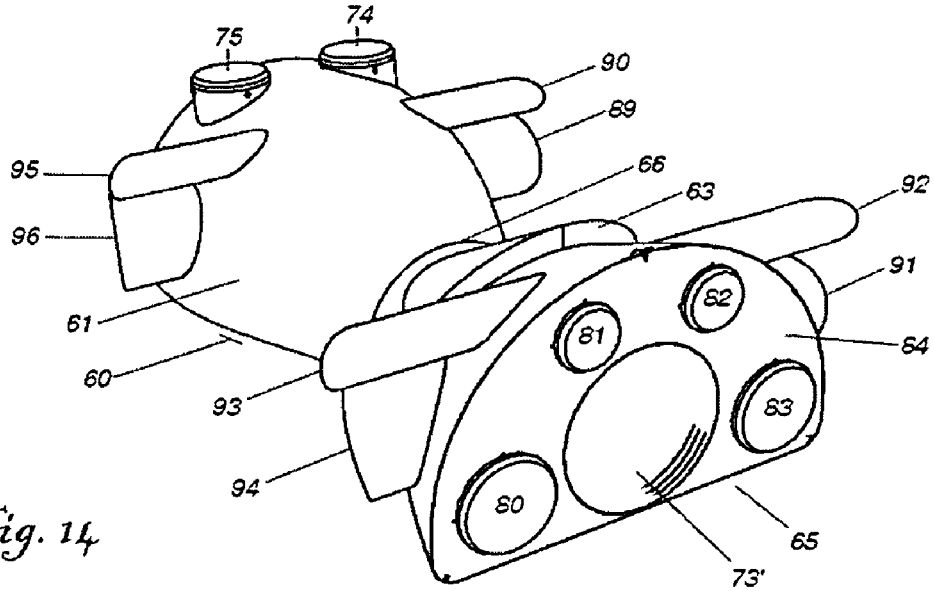
FIG. 14 shows a perspective view of the back of an embodiment of the drum as in FIG. 11
Figure 15:
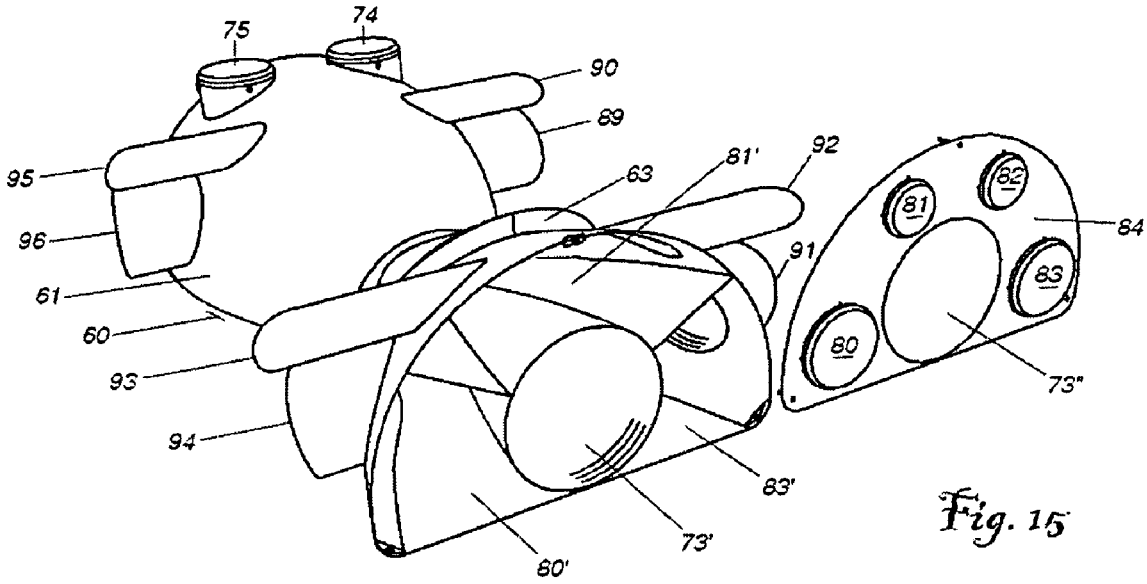
FIG. 15 shows a perspective view of the back of an embodiment of the drum as in FIG. 11 with the backplate removed to expose the resonant chambers within the back section of the outer shell

Furthermore, the flat base 19, as seen in FIG. 6, that forms the flat side of the outer shell 11 can be considered the bottom of the drum 10. The bottom of the drum can be situated on a floor with the front end 17 and back end 18 vertical or nearly vertical to the floor. A cushion or seat 13 can be affixed, using conventional means such as bolts, to the top of the outer shell 11 of the drum where the narrow section of the hourglass shape widens towards the back end 18. The portion of the outer shell 11 that supports the seat 13 is appropriately reinforced using a rigid material to support the weight of the player. A player utilizing the seat 13 would straddle the drum in such a way that he or she is facing the front end 17 of the drum. A player so situated would have convenient access to the multiple playing surfaces 20 21 22 23 mounted to the frontplate 12 of the drum 10. Additionally, a player so situated would have convenient access to playing surfaces 80 81 82 83 mounted to the backplate 84 of the drum, if a backplate is included, as in the embodiment of the drum that is illustrated in FIGS. 14 and 15. The drum can also be played by more conventional means, with the player seated in a chair or on a stool and holding the drum between his or her legs.

Figure 7:
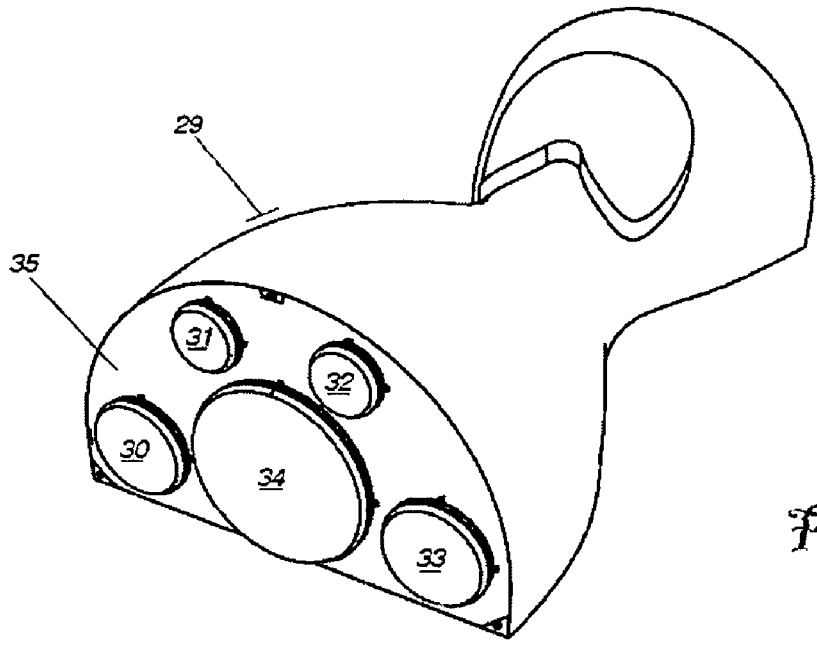
FIG. 7 shows a perspective view of an embodiment of the drum that includes two playing surfaces that are mounted to a single resonant chamber within the outer shell
Figure 8:
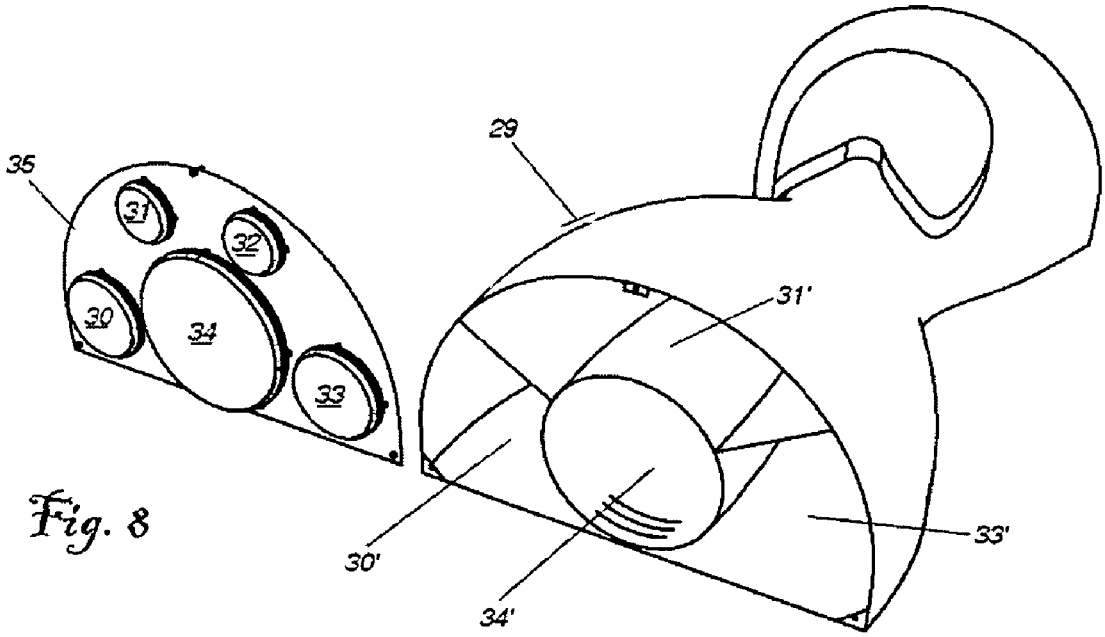
FIG. 8 shows a perspective view of an embodiment of the drum as in FIG. 7 with the frontplate removed to expose the resonant chambers within the outer shell

In another embodiment of the drum with multiple playing surfaces and a seat for the player 29, illustrated in FIGS. 7 and 8, a frontplate 35 with five playing surfaces 30 31 32 33 34 is mounted to the outer shell with four resonant chambers 30' 31' 33' 34'. In this embodiment, two playing surfaces 31 and 32 are mounted to a single resonant chamber 31' as illustrated in FIG. 8.

Figure 9:
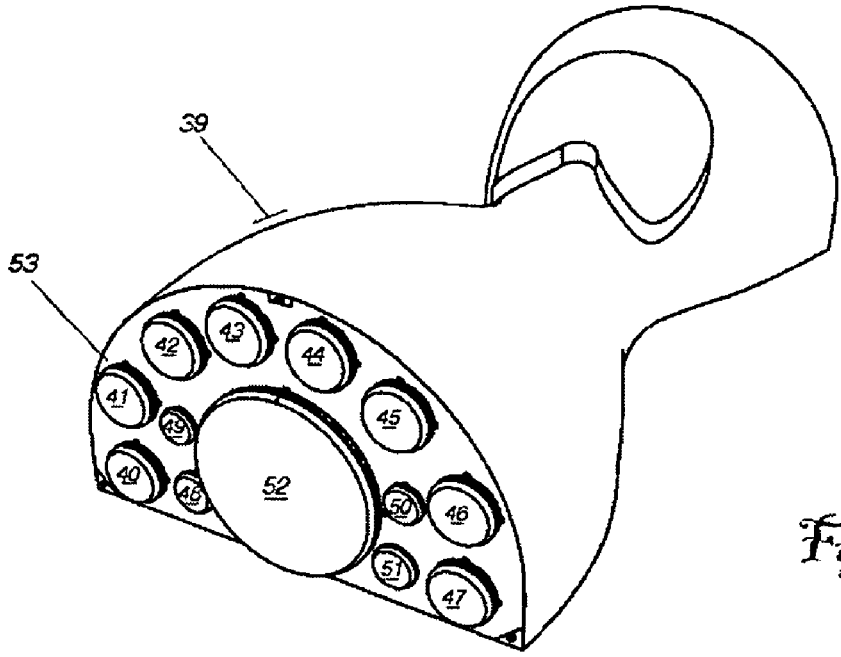
FIG. 9 shows a perspective view of an embodiment of the drum with thirteen playing surfaces each one of which is mounted to a distinct resonant chamber
Figure 10:
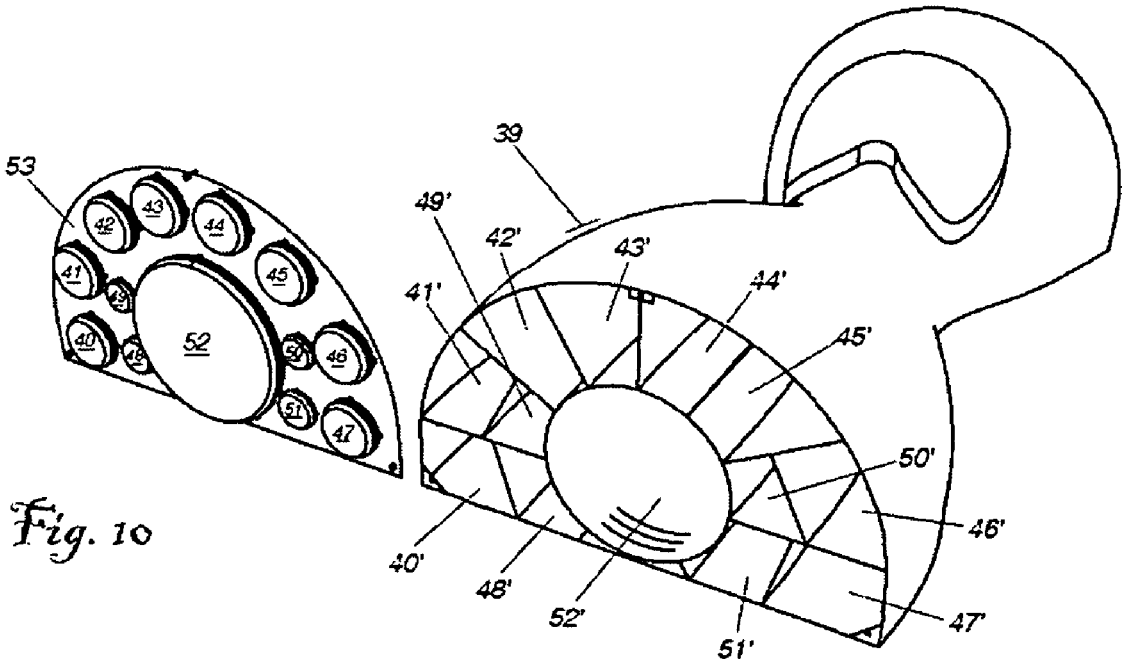
FIG. 10 shows a perspective view of an embodiment of the drum as in FIG. 9 with the frontplate removed to expose the resonant chambers within the outer shell
Figure 11:
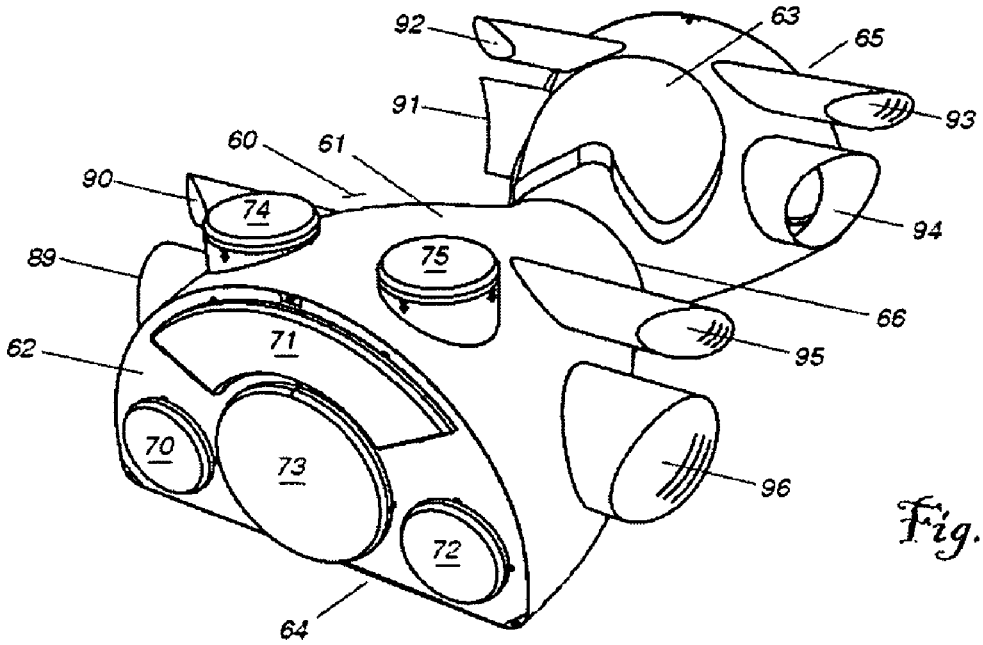
FIG. 11 shows a perspective view of an embodiment of the drum with a cross section near the midpoint and side terminating resonant chambers that allow for playing surfaces to be mounted to the front end and back end of the drum
Figure 12:
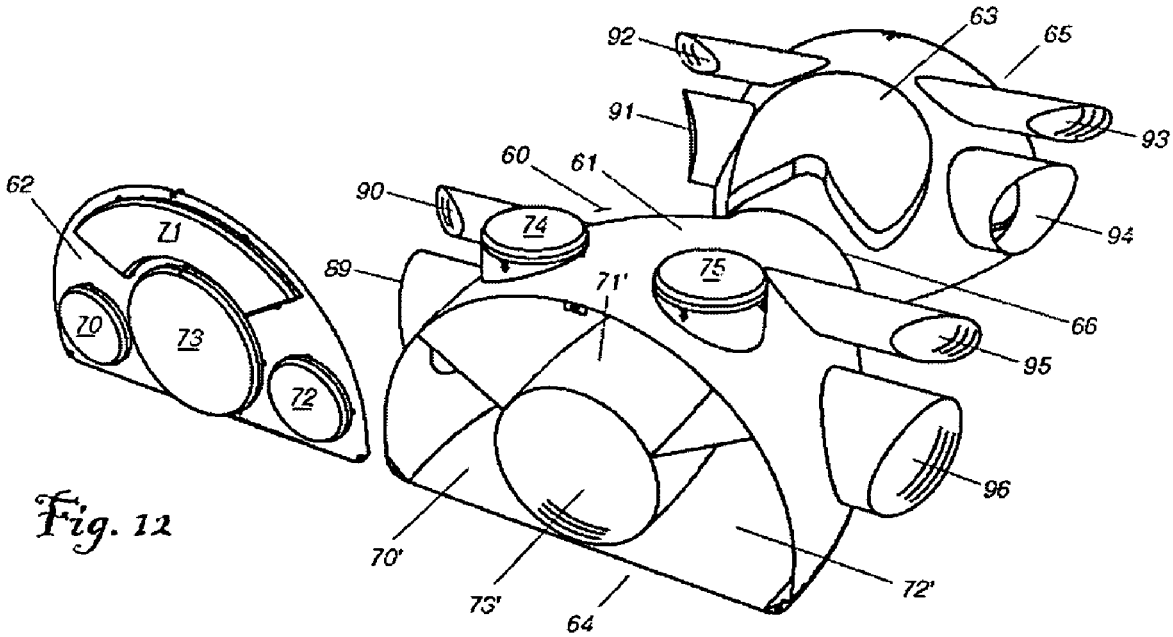
FIG. 12 shows a perspective view of an embodiment of the drum as in FIG. 11 with the frontplate removed to expose the resonant chambers within the front section of the outer shell

In another embodiment of the drum with multiple playing surfaces and a seat for the player 39, illustrated in FIGS. 9 and 10, a frontplate 53 with thirteen playing surfaces 40 41 42 43 44 45 46 47 48 49 50 51 52 is mounted to the outer shell, with additional dividers added to the interior of the outer shell such that each one of the thirteen playing surfaces corresponds to a distinct resonant chamber 40' 41' 42' 43' 44' 45' 46' 47' 48' 49' 50' 51' 52'. This design allows for the possibility of a drum which can produce a full octave of tones from twelve playing surfaces 40 41 42 43 44 45 46 47 48 49 50 51, plus a deeper bass tone from playing surface 52.

Figure 13:
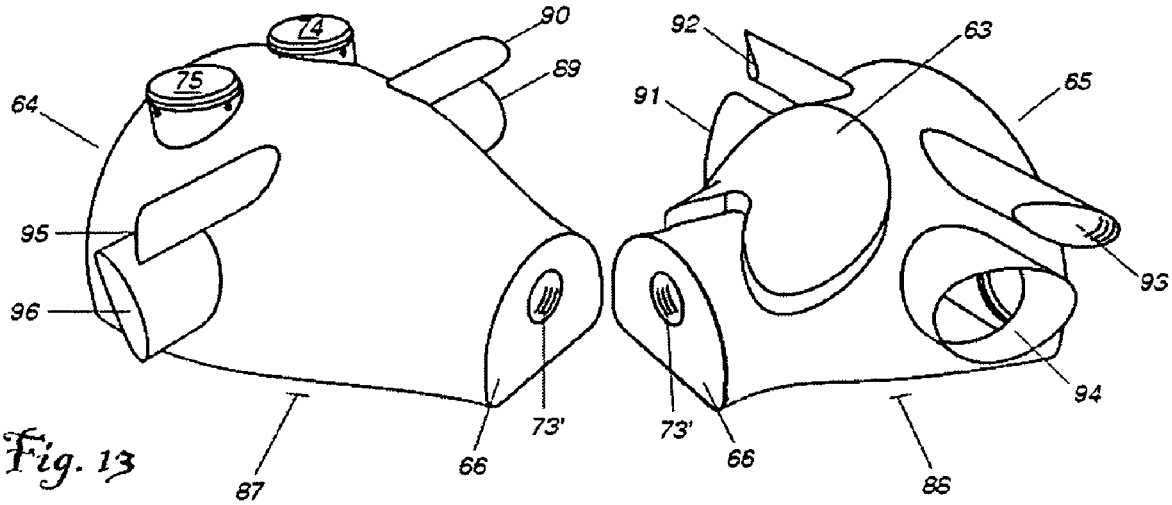
FIG. 13 shows a view of an embodiment of the drum as in FIG. 11 with a split at the cross section near the midpoint to expose the front and back sections of the outer shell

In yet another embodiment of the drum with multiple playing surfaces and a seat for the player 60, illustrated in FIGS. 11, 12, 13, 14 and 15, a cross section divider 66 is added near the midpoint of the outer shell 61 which intersects resonant chambers 70' 71' 72' 80' 81' 83' and creates an outer shell 61 with a front section 87 and a back section 88, as seen in FIG. 13. The cross section divider 66 allows for playing surfaces to be mounted to the front end 64 and back end 65 of the drum 60. In this embodiment, playing surface 73 is mounted to the frontplate 62 and connected to resonant chamber 73'. Resonant chamber 73' starts at the front end 64 of the outer shell 61, passes through the cross section divider 66, as seen in FIG. 13, and terminates at the back end 65 of the outer shell. Resonant chamber 73' terminates at the back end 65 of the outer shell out of cutout 73" in the backplate 84. The cross section divider 66 intersects the remaining resonant chambers 70' 71' 72' 80' 81' 83' and prevents air from passing through the full length of the outer shell 61. Each remaining resonant chamber 70' 71' 72' 80' 81' 83' terminates at side openings 89 90 91 92 93 94 95 96 that are added to the outer shell for this embodiment. Playing surface 70 is connected to resonant chamber 70' which terminates at side opening 89. Playing surface 71 is connected to resonant chamber 71' which terminates at side openings 90 and 95. Playing surfaces 74 and 75 are mounted to the top of the outer shell 61 and are also connected to resonant chamber 71' which terminates at side openings 90 and 95. Playing surface 72 is connected to resonant chamber 72' which terminates at side opening 96. Playing surface 80 is connected to resonant chamber 80' which terminates at side opening 94. Playing surfaces 81 and 82 are connected to resonant chamber 81' which terminates at side openings 92 and 93. Playing surface 83 is connected to resonant chamber 83' which terminates at side opening 91. Embodiment 60 also includes a seat 63 for the player.

Advantages of the "musical drum with multiple playing surfaces and a seat for the player":

(a) Single outer shell for a unitary musical instrument.

(b) Single outer shell for a compact instrument design.

(c) Internal dividers create a single outer shell with a plurality of resonant chambers.

(d) A plurality of resonant chambers allows for a wide range of tonal options.

(e) Internal dividers allow for resonant chambers in a variety of shapes and sizes for a wide range of tonal options.

(f) A plate allows for a plurality of cutouts in a variety of shapes and sizes for a wide range of tonal options.

(g) Cutouts in plate allow for a plurality of playing surfaces in a variety of shapes and sizes to be mounted to them for a wide range of tonal options.

(h) Cutouts in plate allow for playing surfaces of a variety of different materials to be mounted to them, including natural and synthetic skins, wood and metal, for a wide range of tonal options.

(i) Cutouts in plate allow for playing surfaces to be interchangeable for a wide range of tonal options.

(j) Cutouts in plate allow for playing surfaces to be mounted in a variety of different spatial arrangements for a wide range of playing options.

(k) Cutouts in plate allow for playing surfaces to be mounted in close proximity so that a player can strike two playing surfaces simultaneously.

(l) Playing surfaces mounted to cutouts in plate by conventional means allow for independent tuning of each playing surface for a wide range of tonal options.

(m) A plurality of playing surfaces allows for the possibility of creating an "octave drum," a drum with at least twelve distinct, independently tunable playing surfaces each connected to a distinct resonant chamber in a single outer shell that is capable of playing a full octave range of tones.

(n) Each distinct playing surface can be mounted to a distinct resonant chamber within the outer shell to reduce or eliminate sound wave interference.

(o) More than one playing surface can be mounted to a distinct resonant chamber within the outer shell to allow for the creative use of sound wave interference.

(p) Playing surfaces can be mounted to the top portion of the outer shell to allow for a variety of spatial relations for playing surfaces.

(q) A cross section divider added to the interior of the outer shell allows for playing surfaces to be mounted to the front end and back end of the outer shell.

(r) Side openings in the outer shell allow for surfaces to be mounted to the front end and back end of the outer shell.

(s) An outer shell with a flat side that can be used as a base.

(t) A seat added to the outer shell provides a means for a player to be situated in convenient spatial relation to playing surfaces.

(u) A seat for the player provides a means for a player to situate himself or herself in relation to playing surfaces for long periods of playing.

(v) A seat added to the outer shell gives a player access to playing surfaces mounted to the front end and back end of the outer shell.

What is claimed is:

1. A musical drum comprising:

(a) an outer shell divided internally into a plurality of resonant chambers;

(b) at least one plate;

(c) a plurality of cutouts in said plate;

(d) a plurality of playing surfaces that are mounted to said cutouts in said plate;

(e) said plate mounted to said outer shell such that a plurality of said playing surfaces can be joined to a single said resonant chamber within said outer shell and a single said playing surface can be joined to a single said resonant chamber within said outer shell.

2. The musical drum of claim 1 wherein said playing surfaces are interchangeable with playing surfaces of similar shape and size and are constructed of a variety of materials, including natural skins, synthetic skins, wood and metal.

3. The musical drum of claim 1 wherein each said playing surface is independently tunable.

4. The musical drum of claim 1 wherein a seat is attached to said outer shell such that said outer shell serves as the base of said seat for the player.

* * * * *